US010340628B2

(12) United States Patent
Borkar et al.

(10) Patent No.: US 10,340,628 B2
(45) Date of Patent: Jul. 2, 2019

(54) CAP FOR COVERING A PLUG OPENING

(71) Applicant: Appleton Grp LLC, Rosemont, IL (US)

(72) Inventors: Tushar Borkar, Pune (IN); Vilas S. Shendge, Pune (IN); Abhinav S. Sachan, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 53 days.

(21) Appl. No.: 15/812,029

(22) Filed: Nov. 14, 2017

(65) Prior Publication Data

US 2019/0089090 A1 Mar. 21, 2019

(30) Foreign Application Priority Data

Sep. 21, 2017 (IN) ..... 201721033558

(51) Int. Cl.
*H01R 13/52* (2006.01)
*H01R 13/53* (2006.01)

(52) U.S. Cl.
CPC ..... *H01R 13/5213* (2013.01); *H01R 13/53* (2013.01)

(58) Field of Classification Search
CPC ..... H01R 13/53; H01R 13/5213
USPC ..... 439/136, 135, 528
See application file for complete search history.

(56) References Cited

U.S. PATENT DOCUMENTS 2,483,304 A * 9/1949 Vogel ..... A24F 15/12 16/226
5,136,755 A * 8/1992 Shaw ..... F16G 11/05 24/122.6
5,524,749 A * 6/1996 Thompson ..... A45C 11/182 150/147
5,588,853 A * 12/1996 Anthony ..... H01R 13/5213 220/375
6,065,981 A * 5/2000 Sopotnick ..... H01R 13/447 439/135
8,333,296 B1 * 12/2012 Fung ..... B65D 21/0219 220/592.17
2005/0176279 A1 * 8/2005 Khemakhem ..... H01R 4/70 439/135
2006/0148287 A1 * 7/2006 Zahnen ..... H01R 13/518 439/135
2010/0081327 A1 * 4/2010 Tusini ..... H01R 24/542 439/620.21
2015/0171542 A1 * 6/2015 Pietila ..... H01R 13/447 439/135

* cited by examiner

*Primary Examiner* — Travis S Chambers
(74) *Attorney, Agent, or Firm* — McDonnell Boehnen Hulbert & Berghoff LLP

(57) ABSTRACT

The present disclosure envisages a cap for covering a plug opening. The cap comprises at least one recessed portion having a cross section complementary to a cross section of the plug opening, wherein a first operative end of the recessed portion is fitted into the plug. A top lid is configured on the recessed portion. The top lid and the at least one recessed portion are adapted to prevent ingress of foreign particles to the plug. A lanyard extends from the recessed portion, and a ring is configured at a free end of the lanyard. The ring is adapted to be fitted on a body of the plug. The lanyard and the ring allow the cap to remain attached to the plug in the configuration when the at least one recessed portion is fitted on or not fitted on the plug.

15 Claims, 4 Drawing Sheets

CAP FOR COVERING A PLUG OPENING

RELATED APPLICATIONS

This application claims priority to Indian Patent Application No. IN201721033558 entitled "A Cap for Covering a Plug Opening" filed on Sep. 21, 2017, incorporated herein by reference in its entirety.

FIELD

The present disclosure relates to the field of industrial power plugs and receptacles.

BACKGROUND

Industrial power plugs are used in applications where the current and the voltage parameters are very high. The locations at which these plugs are used are generally industrial setups such as in mining industries, petrochemical industries, and the like. All of these industrial setups have a lot of large sized particles and other waste materials, which are direct byproducts of the industrial process being performed in the industrial set up, such as mining products, pebbles stones, dust, water, and the like. These particles tend to enter the industrial power plugs and may become a cause of an industrial accident if proper precautions are not taken by the human operator to properly clean the plug before connecting it to the receptacle. Another disadvantage associated with the conventional industrial plugs is the absence of shock absorption means on the body of the plug. Since the plug is used in rugged conditions, it is bound to accidently fall. This causes the breaking or deformation of the conventional industrial plugs that are primarily made of a plastic material.

Hence, in order to overcome the aforementioned drawbacks, there is need of a cap for covering the industrial power plug when not in use, and provides damping to the industrial power plug opening against accidental falls.

OBJECTS

Some of the objects of the present disclosure, which at least one embodiment herein satisfies, are as follows:

An object of the present disclosure is to provide a cap for covering a plug when the plug is not in use.

Another object of the present disclosure is to provide a cap for a plug which provides damping to the plug against accidental falls while preventing the distortion of the plug opening.

Yet another object of the present disclosure is to provide a cap which can be used on plugs of different cross sections or diameters.

Other objects and advantages of the present disclosure will be more apparent from the following description, which is not intended to limit the scope of the present disclosure.

SUMMARY

The present disclosure envisages a cap for covering a plug opening. The cap comprises at least one recessed portion having a cross section complementary to the cross section of the plug, wherein a first operative end of the recessed portion is configured to fit into the plug opening. A top lid is configured on the recessed portion. The top lid and the recessed portion are adapted to prevent ingress of foreign particles to the plug. A lanyard extends from the recessed portion. A ring is configured at a free end of the lanyard. The ring is adapted to be fitted on a body of the plug. The lanyard and the ring allow the cap to remain attached to the plug in the configuration when the at least one recessed portion is fitted in or not fitted in the plug opening.

The lanyard is longitudinally flexible, and is configured to be twisted along the longitudinal axis thereof.

In an embodiment, the cap comprises two recessed portions co-axially extending from opposite surfaces of the top lid. The two recessed portions have unequal cross sections to facilitate the cap to cover plugs of different cross sections or diameters.

The cap further comprises a sealing lip configured on the at least one recessed portion to allow tight fitment of the recessed portion in the plug opening.

In an embodiment, the at least one recessed portion has a cylindrical shape.

In another embodiment, the recessed portion, the top lid, the lanyard, and the ring are made of at least one material selected from a group consisting of rubber and silicon.

In another embodiment, the lanyard is provided with a reinforcing wire.

In another embodiment, the lanyard is integral with the at least one recessed portion and the ring.

In yet another embodiment, the lanyard is provided with a metallic core, wherein the metallic core is a spring. A layer of resilient material is injection moulded on the metallic core to provide a reinforced lanyard. The resilient material is at least one selected from rubber and silicon.

In yet another embodiment, the cap is locked on the body of the plug via a locking bracket that is insertable in a slot configured on the cap such that a locking portion of the locking bracket extends beyond a periphery of the cap. In an assembled configuration, the locking portion extends through a slot configured on the body of the plug, and a padlock is used for locking the locking bracket and the dust cap with the body.

BRIEF DESCRIPTION OF THE ACCOMPANYING DRAWINGS

A cap for covering a plug, of the present disclosure, will now be described with the help of the accompanying drawings, in which.

LIST OF REFERENCE NUMERALS

50—Plug
100, 100', 100"—Cap
102, 102'—Recessed portions
102A—First operative end
104—Top lid
106—Lanyard
108—Ring
110—Sealing lip

112—Slot
114—Locking Bracket
116—Slot
118—Padlock

DETAILED DESCRIPTION

The present disclosure envisages a cap for covering a plug opening when the plug is not in use. Further, the present disclosure envisages a cap for the plugs which provides damping to the plug against accidental falls. Furthermore, the present disclosure envisages a cap which can be used with plugs having different cross sections or diameters.

Figure 1A:
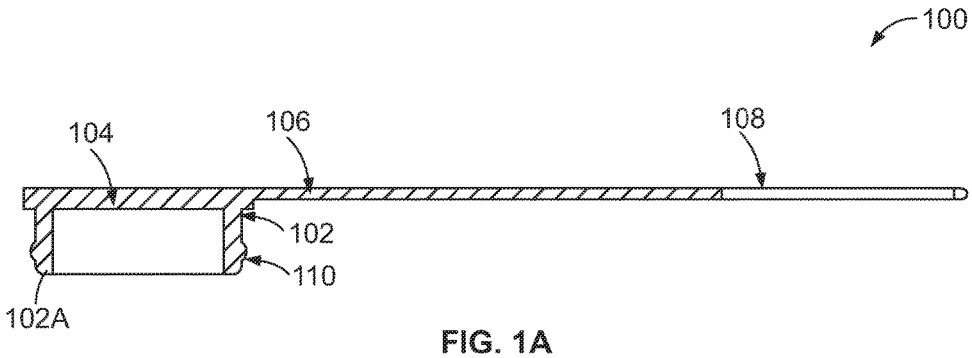
FIG. 1A and FIG. 1B illustrate a sectional view and a top view of the cap, in accordance with an embodiment of the present disclosure.
Figure 1B:
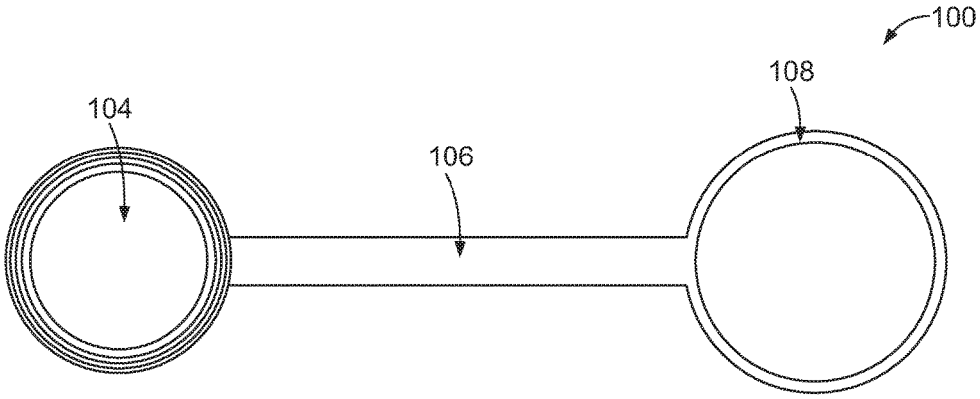

A cap 100 for covering an opening of a plug 50 (see FIG. 3) is now described with reference to FIG. 1A and FIG. 1B. The cap 100 comprises at least one recessed portion 102 having a cross section complementary to the cross section of the plug 50, wherein a first operative end 102A of the recessed portion 102 is fitted into the plug 50. In an exemplary embodiment, the plug 50 is an industrial power plug.

A top lid 104 is configured on the recessed portion 102. The top lid 104 and the recessed portion 102 are adapted to prevent ingress of foreign particles to the plug 50. More specifically, when the recessed portion 102 is configured to fit into the plug 50, the top lid 104 covers the plug 50 and prevents entry of foreign particles such as pebbles, mining products, and the like in the plug 50. A lanyard 106 extends from the recessed portion 102. A ring 108 is configured at a free end of the lanyard 106. The ring 108 is adapted to be fitted on a body of the plug 50. The lanyard 106 and the ring 108 allow the cap 100 to the plug 50 in the configuration when the at least one recessed portion 102 is fitted on or not fitted on the plug 50.

In an embodiment, the lanyard 106 is longitudinally flexible. Further, the lanyard 106 is configured to be twisted along the longitudinal axis thereof.

The cap 100 further comprises a sealing lip 110 configured on the at least one recessed portion 102 to allow tight fitment of the recessed portion 102 into the interior of plug 50. More specifically, the sealing lip 110 facilitates a tight fitment of the cap 100 into the plug 50, so as to prevent ingress of foreign particles into the plug 50 along the periphery of the recessed portion 102. As such, the top lid 104 provides primary ingress protection against foreign particles, whereas the sealing lip 110 provides peripheral ingress protection against foreign particles to the plug 50.

Figure 2A:
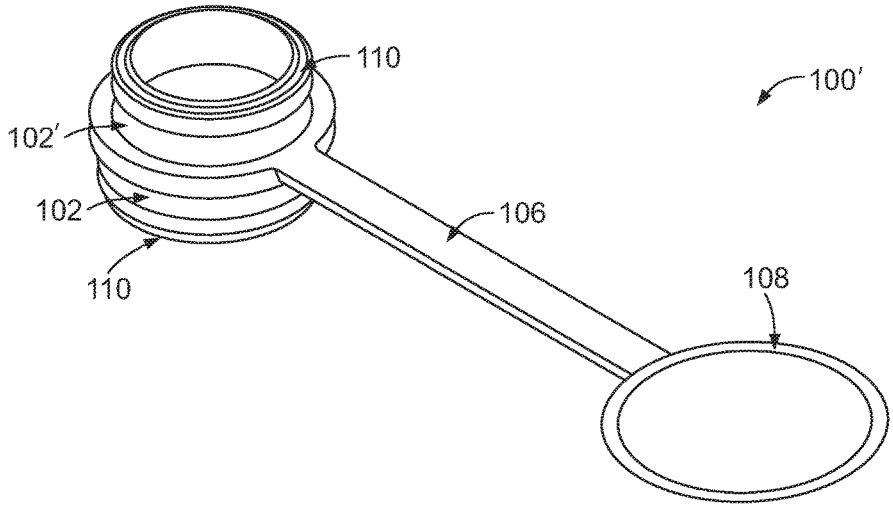
FIG. 2A and FIG. 2B illustrate an isometric view and a sectional view of the cap, in accordance with another embodiment of the present disclosure.
Figure 2B:
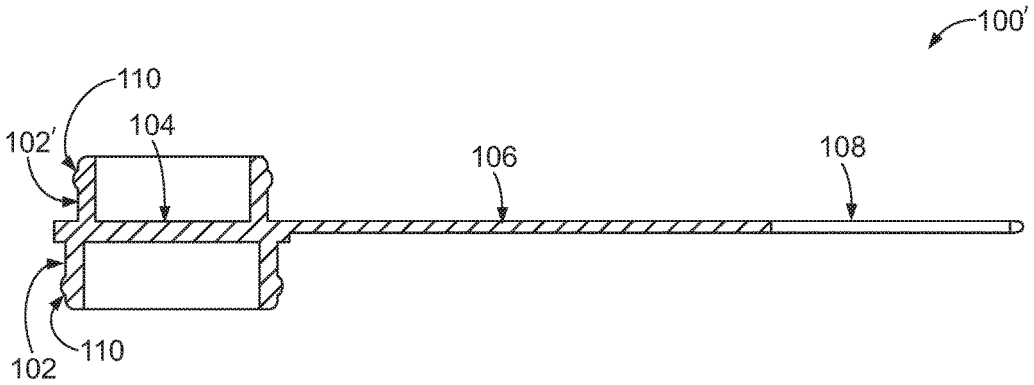
Figure 3:
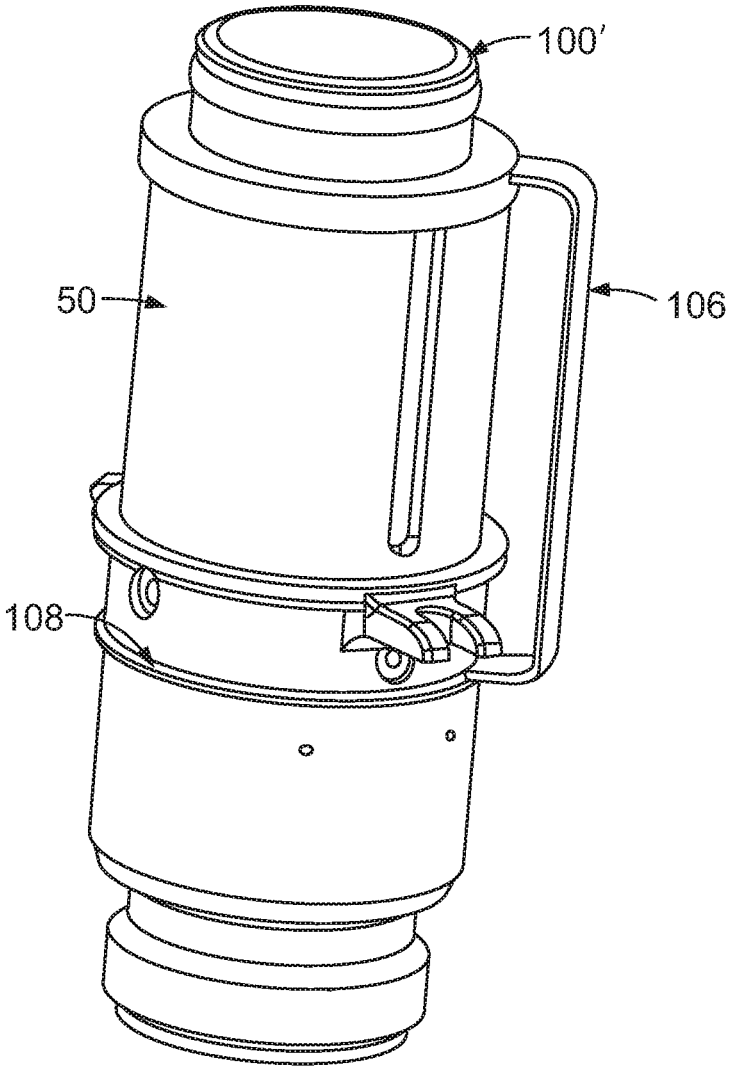
FIG. 3 illustrates an isometric view of an assembly of the cap and a plug, in accordance with an embodiment of the present disclosure.

Another embodiment of the cap 100' has been illustrated in FIG. 2A and FIG. 2B; and FIG. 3 illustrates an isometric view of an assembly of the cap 100' positioned in plug 50. In this embodiment, the cap 100' comprises two recessed portions 102, 102'. Each recessed portion 102, 102' co-axially extends from the opposite operative surfaces of the top lid 104. The two recessed portions 102, 102' have unequal cross sections to facilitate the cap 100' to cover plugs of different cross sections or diameters. This reduces the costs associated with the inventory as it eliminates the need to manufacture two different configurations of the cap 100.

It is to be noted that all the other features and characteristics of the cap 100' are same as those described with reference to the cap 100 and are not described again for the sake of brevity of the present document. The like elements of cap 100 and cap 100' are referenced by like numerals.

In an embodiment, the recessed portions 102, 102' configured on the cap 100' have a cylindrical shape.

The cap 100', or more specifically the recessed portion 102, the top lid 104, the lanyard 106, and the ring 108 are made of at least one material selected from the group consisting of rubber and silicon. In another embodiment, the cap 100 is made of at least one material selected from the group consisting of neoprene, nitrile rubber, ethylene propylene rubber, silicone rubber, polyurethane, and polybutadiene.

In an embodiment, the lanyard 106 is integral with the recessed portion 102, 102' and the ring 108.

In another embodiment, the lanyard 106 is provided with a reinforcing wire.

In another embodiment, the lanyard 106 is reinforced. More specifically, the lanyard 106 is provided with a metallic core to give strength to lanyard 106. In an embodiment, the metallic core is a spring. The metallic core provides a secure suspension of the cap 100. A layer of resilient material is injection moulded on the metallic core to provide a reinforced lanyard. The resilient material is at least one selected from rubber and silicon. In another embodiment, the resilient material is at least one material selected from a group consisting of neoprene, nitrile rubber, ethylene propylene rubber, silicone rubber, polyurethane, and polybutadiene.

Figure 4:
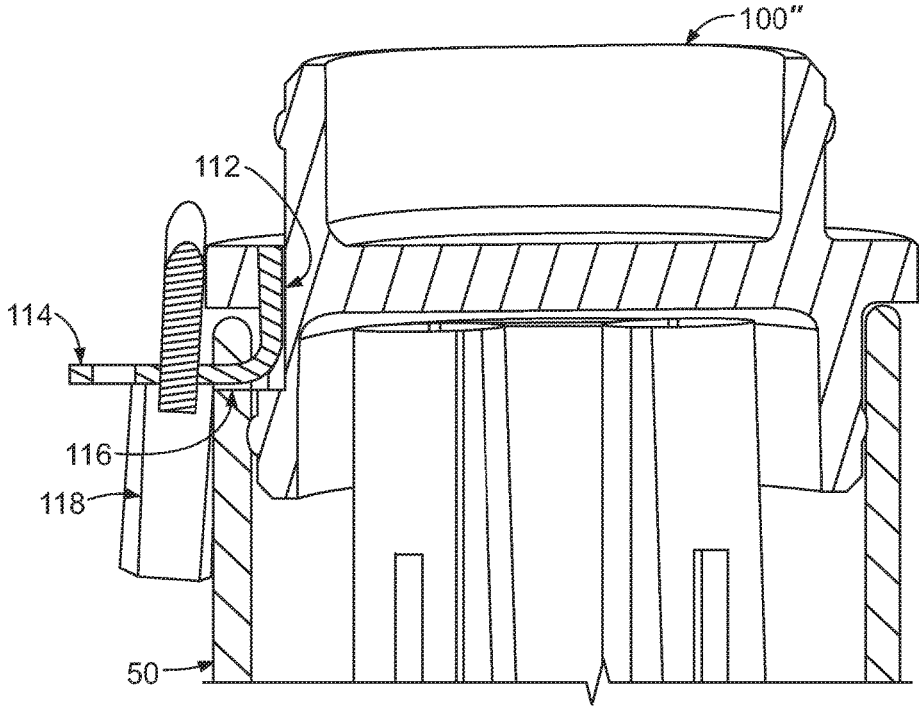
FIG. 4 illustrates a schematic view of an assembly of a cap and a plug, in accordance with an embodiment of the present disclosure.

FIG. 4 illustrates a sectional view of a dust cap 100", in accordance with another embodiment of the present disclosure. The dust cap 100" is provided with a slot 112 for accommodating a locking bracket 114. In an assembled configuration, the locking bracket 114 extends through the slot 112, and the dust cap 100", being made of a flexible material, is deformed to fit into the plug opening such that the locking bracket 114 is also made to pass through a slot 116 configured on the plug body. Subsequent to the assembly in the aforementioned manner, a padlock 118 can be used to lock the locking bracket 114, and consequently the dust cap 100", on the plug body. The locking bracket 114 prevents a bottom portion of dust cap 100" from being removed from the plug housing 50, thereby locking the dust cap 100" to the plug housing 50.

The caps 100, 100', 100" of the present disclosure prevents the ingress of the foreign particles such pebble stones, dust particles, water, and the like in the plug, particularly in industrial power plug, when the plug is inoperational. Furthermore, the caps 100, 100', 100" are made of a material which is resilient, shock proof, impact absorbent, water resistant, and oil resistant. As such, there is no deterioration of the caps 100, 100', 100" due to exposure to water, oil, or any other material to which the caps 100, 100', 100" of the present disclosure are exposed in the industrial set up. Furthermore, the impact absorbent tendency of the material of the caps 100, 100', 100" also provides shock absorption to the plug in case of accidental falls of the plug. This improves the service life of the plug as the breakage of the plug is prevented due to the shock absorption.

TECHNICAL ADVANCEMENTS

The present disclosure described herein above has several technical advantages including, but not limited to, the realization of a cap that:

- covers the plug when not in use;
- provides damping or shock absorption to the plug for protection during accidental falls; and
- can be used on plugs of different cross sections or diameters.

The disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully revealed the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A cap for covering a plug opening, said cap comprising:

a first recessed portion having a cross section complementary to a cross section of said plug opening, wherein a first operative end of said first recessed portion is configured to fit into said plug opening;

a sealing lip configured on an exterior surface of the first recessed portion to allow tight fitment of said first recessed portion within an interior of said plug opening;

a top lid configured on said first recessed portion, said top lid and said first recessed portion adapted to prevent ingress of foreign particles to said plug;

a lanyard extending from said first recessed portion;

a ring configured at a free end of said lanyard, said ring adapted to be fitted on a body of said plug, said lanyard and said ring allowing said cap to remain attached to said plug in the configuration when said first recessed portion is fitted on or not fitted on said plug; and further including a second recessed portion co-axially extending from an opposite operative surface of said top lid from the first recessed portion.

2. The cap as claimed in claim 1, wherein said lanyard is longitudinally flexible, and configured to be twisted along the longitudinal axis thereof.

3. The cap as claimed in claim 1, wherein said first and second recessed portions have unequal cross sections to facilitate said cap to cover plugs of different cross sections.

4. The cap as claimed in claim 1, wherein said first recessed portion has a cylindrical shape.

5. The cap as claimed in claim 1, wherein said first recessed portion, said top lid, said lanyard, and said ring are made of at least one material selected from a group consisting of rubber and silicon.

6. The cap as claimed in claim 1, wherein said cap is made of at least one material selected from the group consisting of neoprene, nitrile rubber, ethylene propylene rubber, silicone rubber, polyurethane, and polybutadiene.

7. The cap as claimed in claim 1, wherein said lanyard is provided with a reinforcing wire.

8. The cap as claimed in claim 1, wherein said lanyard is integral with said at least one recessed portion and said ring.

9. The cap as claimed in claim 1, wherein said lanyard is provided with a metallic core.

10. The cap as claimed in claim 9, wherein said metallic core comprises a layer of a resilient material injection moulded thereon to provide a reinforced lanyard.

11. The cap as claimed in claim 10, wherein said resilient material is at least one selected from rubber and silicon.

12. The cap as claimed in claim 10, wherein said resilient material is at least one material selected from a group consisting of neoprene, nitrile rubber, ethylene propylene rubber, silicone rubber, polyurethane, and polybutadiene.

13. A cap for covering a plug opening, said cap comprising:

a first recessed portion having a cross section complementary to a cross section of said plug opening, wherein a first operative end of said first recessed portion is configured to fit into said plug opening;

a top lid configured on said first recessed portion, said top lid and said first recessed portion adapted to prevent ingress of foreign particles to said plug;

a lanyard extending from said first recessed portion;

wherein said lanyard is provided with a metallic core; and a ring configured at a free end of said lanyard, said ring adapted to be fitted on a body of said plug, said lanyard and said ring allowing said cap to remain attached to said plug in the configuration when said first recessed portion is fitted on or not fitted on said plug;

wherein said metallic core is a spring; and further including a second recessed portion co-axially extending from an opposite operative surface of said top lid from the first recessed portion.

14. A cap for covering a plug opening, said cap comprising:

A first recessed portion having a cross section complementary to a cross section of said plug opening, wherein a first operative end of said first recessed portion is configured to fit into said plug opening;

a top lid configured on said first recessed portion, said top lid and said first recessed portion adapted to prevent ingress of foreign particles to said plug;

a lanyard extending from said first recessed portion; and a ring configured at a free end of said lanyard, said ring adapted to be fitted on a body of said plug, said lanyard and said ring allowing said cap to remain attached to said plug in the configuration when said first recessed portion is fitted on or not fitted on said plug;

wherein said cap is locked on said body of said plug via:

a locking bracket insertable in a slot configured on said cap such that a locking portion of said locking bracket extends beyond a periphery of said cap, wherein in an assembled configuration, said locking portion extends through a slot configured on said body of said plug; and a padlock for locking said locking bracket and said cap with said body.

15. The cap of claim 14, further including a second recessed portion co-axially extending from an opposite operative surface of said top lid from the first recessed portion.

* * * * *